US010820704B2

(12) United States Patent
Sugano et al.

(10) Patent No.: US 10,820,704 B2
(45) Date of Patent: Nov. 3, 2020

(54) CHAIR AND SEAT SUPPORT MECHANISM

(71) Applicant: KOKUYO CO., LTD., Osaka-shi, Osaka (JP)

(72) Inventors: Takao Sugano, Osaka (JP); Toshiki Yajima, Osaka (JP); Katsuaki Hayashi, Osaka (JP)

(73) Assignee: KOKUYO CO., LTD., Osaka (JP)

( * ) Notice: Subject to any disclaimer, the term of this patent is extended or adjusted under 35 U.S.C. 154(b) by 0 days.

(21) Appl. No.: 16/305,515

(22) PCT Filed: Jun. 20, 2016

(86) PCT No.: PCT/JP2016/068298
§ 371 (c)(1),
(2) Date: Nov. 29, 2018

(87) PCT Pub. No.: WO2017/221311
PCT Pub. Date: Dec. 28, 2017

(65) Prior Publication Data

US 2019/0208910 A1 Jul. 11, 2019

(51) Int. Cl.
*A47C 1/032* (2006.01)
*A47C 1/035* (2006.01)
(Continued)

(52) U.S. Cl.
CPC ..... *A47C 3/026* (2013.01); *A47C 3/18* (2013.01); *A47C 7/02* (2013.01); *A47C 7/14* (2013.01); *A47C 7/441* (2013.01); *A47C 1/03255* (2013.01)

(58) Field of Classification Search
CPC .. A47C 7/02; A47C 7/026; A47C 7/14; A47C 7/18; A47C 7/441; A47C 1/03255; A47C 3/026
(Continued)

(56) References Cited

U.S. PATENT DOCUMENTS 4,575,151 A * 3/1986 Edstrom ..... A47C 3/026 297/302.6
5,901,612 A * 5/1999 Letovsky ..... A47C 1/12 297/314 X
(Continued)

FOREIGN PATENT DOCUMENTS

CN 102 415 714 B 7/2013
DE 10 2006 021439 A1 2/2007
(Continued)

OTHER PUBLICATIONS

International Search Report dated Jul. 26, 2016, issued in counterpart International Application No. PCT/JP2016/068298 (2 pages).
(Continued)

*Primary Examiner* — Rodney B White
(74) *Attorney, Agent, or Firm* — Westerman, Hattori, Daniels & Adrian, LLP

(57) ABSTRACT

To provide a chair in which the seated person can perceive a comfortable sitting feeling even if sitting for a long time, and furthermore, a high work efficiency can stably be maintained, a chair according to the present invention includes a leg 1 erected on a floor surface, a seat 3 supported above the leg 1 and a suspension support mechanism 5 configured to operatively support the seat 3, in a front-rear direction and in a right-left direction, along a predetermined trajectory by suspending the part of the seat 3 from a part of the leg 1, the suspension support mechanism 5 comprises a inclining function Q configured to downwardly incline the seat 3 so that a tip side in a movement direction of the seat 3 is positioned below a base end side when the seat 3 operates from a reference position_(S) at which the seat 3 can rest by its own weight.

19 Claims, 13 Drawing Sheets

(51) Int. Cl.

| | |
|---|---|
| ***A47C 3/025*** | (2006.01) |
| ***A47C 3/026*** | (2006.01) |
| ***A47C 7/02*** | (2006.01) |
| ***A47C 7/14*** | (2006.01) |
| ***A47C 7/44*** | (2006.01) |
| ***A47C 3/18*** | (2006.01) |

(58) Field of Classification Search
USPC ..... 297/314, 316, 322
See application file for complete search history.

(56) References Cited

U.S. PATENT DOCUMENTS

| | | | | |
|---|---|---|---|---|
| 7,008,017 | B1 * | 3/2006 | Wegener | A47C 9/002 297/314 |
| 7,100,983 | B1 * | 9/2006 | Gant | A47C 3/025 297/314 X |
| 8,029,060 | B2 * | 10/2011 | Parker | A47C 1/023 297/314 X |
| 8,439,442 | B2 * | 5/2013 | Highlander | A47C 7/14 297/314 X |
| 10,058,180 | B2 * | 8/2018 | Desanta | A47C 7/448 |
| 2003/0015900 | A1 | 1/2003 | Lu | |
| 2005/0264068 | A1 | 12/2005 | Bodinek | |
| 2009/0261642 | A1 * | 10/2009 | Dickie | A47C 7/446 297/314 |
| 2009/0278388 | A1 * | 11/2009 | Reingewirtz | A47C 3/025 297/314 X |
| 2019/0045928 | A1 * | 2/2019 | Yajima | A47C 1/024 |
| 2019/0281985 | A1 * | 9/2019 | Kinoshita | A47C 7/441 |
| 2019/0281986 | A1 * | 9/2019 | Sugano | A47C 3/027 |
| 2019/0290006 | A1 * | 9/2019 | Kinoshita | A47C 3/0257 |
| 2019/0343286 | A1 * | 11/2019 | Sugano | A47C 3/027 |
| 2020/0085195 | A1 * | 3/2020 | Shibamoto | A47C 7/024 |

FOREIGN PATENT DOCUMENTS

| | | | |
|---|---|---|---|
| EP | 1 197 168 | A2 | 4/2002 |
| GB | 191029969 | A | 10/1911 |
| JP | 62-64313 | A | 3/1987 |
| JP | 1-291809 | A | 11/1989 |
| JP | 2005-058719 | A | 3/2005 |
| JP | 2012-10938 | A | 1/2012 |

OTHER PUBLICATIONS

Office Action dated Mar. 31, 2020, issued in counterpart JP Application No. 2018-523181, with English translation (8 pages).
Office Action dated Jul. 3, 2020, issued in counterpart CA Application No. 3,025,250 (4 pages).
Extended Search Report dated Aug. 19, 2020, issued in counterpart EP Application No. 20166180.8 (9 pages).

* cited by examiner

CHAIR AND SEAT SUPPORT MECHANISM

TECHNICAL FIELD

The present invention relates to a chair suitably applicable to an office rotating chair and the like.

BACKGROUND ART

Conventionally, chairs, especially office rotating chairs, with an aim that a seated person can maintain a comfortable sitting posture for a long time in an office, at home or the like, have been widely devised (for example, see Patent Document 1).

These office rotating chairs are configured so that a seat and a backrest can be tilted in accordance mainly with a rearward inclining and forward inclining movement of the seated person and are configured so that the seat and the backrest can be fixed in a position allowing for realization of a required posture of the seated person, so that an operation allowing the seated person to feel comfort while proceeding a work is possible.

CITATION LIST

Patent Literature

Patent Document 1: Japanese Unexamined Patent Application Publication No. 2012-010938

SUMMARY OF THE INVENTION

Problem to be Solved by the Invention

Even though, from an outside perspective, it may appear as if a seated person sitting on an office rotating chair for a long time normally rests in a posture in which the person feels comfort, it has become clear that the person actually moves a lumbar region, a gluteal region and further femoral region from the required posture all the time to maintain a comfortable sitting posture on the office rotating chair.

Specifically, even though many seated persons appear, at first glance, to rest in a sitting posture that is comfortable for the persons, it has been seen that the persons actually maintain comfort by the persons' own sitting, while moving, in any direction, that is, in a front-rear direction and a left-right direction with respect to the planar direction, a position of the lumbar region and the gluteal region as the center in planar view, in a posture that is generally comfortable. Additionally, it has become evident that in a state in which such an operation can be performed smoothly, the seated persons feel no discomfort, and further, the state contributes to improving efficiency of work to be done during sitting.

Therefore, it should be understood that present chairs are required to be equipped with a function that allows for a suitable support for the above-described behavior by the seated persons.

An object of the present invention is to solve the problems described above, and an object thereof is to provide a chair, in particular, focusing on repeating the operation of returning to a reference position after the seated person changes the posture from the reference position, by supporting such operation reasonably in a natural state, as a result, the seated person to perceive a comfortable sitting feeling, even if sitting for a long time, and further allows the seated person to stably maintain a high work efficiency.

Means for Solving the Problem

The present invention adopts the following means in order to achieve such an object.

That is, a chair according to the present invention comprises: a leg erected on a floor surface, a seat arranged above the leg and a suspension support mechanism configured to operatively support the seat, in a front-rear direction and in a right-left direction, along a predetermined trajectory by suspending a part of the seat from a part of the leg, wherein the suspension support mechanism comprises a seat inclining function of inclining the front end side in the movement direction of the seat downward when the seat operates from a reference position where the seat can be rested by its own weight.

That is, the inventors of the present application could contemplate the present invention by focusing for the first time on the following advantage that a seated person moves his/her lumbar region, gluteal region, and femoral region to the front, rear, right, and left by a predetermined dimension around a reference position being a center at which the seated person his/herself sits, and when the seat is inclined while the seat is moved horizontally during the movement and further, when the seat is operated so that a backswing force that causes the chair to return to the reference position is naturally obtained, as a result of which it is possible to improve the comfort of the seated person to make the seated person less exhausted while improving work efficiency.

Here, the "predetermined trajectory" indicates a trajectory along which a certain location of the seat can be continuously operated on an operation surface where a horizontal movement amount, a seat surface inclination angle, and an up-down movement amount are associated. A comprehensive example of the certain location includes a position of the center of gravity, but a position other than the center of gravity is also possible. In other words, in accordance with an operation of the seat along the predetermined trajectory, a unique up-down movement amount and seat surface inclination angle respectively determined by a position of the seat in planar view are set, and the seat will be repeatedly and continuously guided to these positions.

Such a configuration not only can suitably maintain a posture of the seated person during sitting, but also can suitably support the movement of the seated person during sitting. Specifically, in view of a tendency of operation resulting from a human body structure of the seated person during sitting, it is possible to configure a chair that can suitably support such an operation. As a result, according to the present invention, it is possible to provide a chair in which the seated person can perceive a comfortable sitting feeling even if sitting for a long time, and a high work efficiency can stably be maintained.

In order to configure the seat inclination function without adding particular components, it is preferable that the suspension support mechanism is set so that a distance between the lower ends is shorter than a distance between the upper end that suspends a part of the seat from above.

When a lifting and lowering mechanism of the seat is adopted, in order to provide a compact configuration instead of a complicated structure where the support mechanism is merged with the lifting and lowering mechanism, it is preferable that the leg includes a lifting and lowering mechanism, the seat is arranged above the lifting and lowering mechanism, and the support mechanism is interposed between the lifting and lowering mechanism and the seat.

In order to realize a smooth operation in accordance with the movement of the seated person, it is preferable that the suspension support mechanism is a link mechanism having a link member extending in an up-down direction.

Further, among the link members, in order to enable more flexible operation and to further improve the followability to the motion of the seated person, it is preferable that the link member is configured as a universal joint of which the both ends are pivotably supported in both a front-rear direction and a right-left direction and the seat and the leg are coupled via the universal joint.

In order to realized that a chair configured to be more compact in the up-down direction, it is preferable that a plurality of link members are provided so that the up-and-down positions overlap at a position surrounding the center of the seat in planar view.

In order to minimize wobbling of the seat supported by the link members, as a result of which the seated person is given a more comfortable sitting feeling, it is preferable that the number of the link members provided is three.

Further, in order to be able to more precisely set the operation range in which the seat can be operated, it is desirable that the suspension support mechanism includes a front-rear support unit configured to operatively support the seat in a front-rear direction and a left-right support unit provided separately from the front-rear support unit and configured to operatively support the seat in a left-right direction.

Further, in order to make a chair more compact in planar view, it is preferable that the front-rear support unit and the left-right support unit are arranged so that the up-and-down positions overlap at a position surrounding the center of the seat.

Considering the behavior of the seated person performing a greater and more frequent operation in the front-rear direction than that in the left-right direction, it is preferable that the front-rear support unit is arranged above the left-right support unit and is positioned closer to the seated person.

Further, in order to ensure that any undesirable shock or noise due to the abrupt operation of the seat is not inflicted on the seated person, it is desirable that the suspension support mechanism includes a shockless unit configured to avoid or absorb a shock caused by a collision of the link members at the operation end.

Further, in order to ensure that any undesirable "fear" or discomfort is not inflicted on the seated person due to an unintended abrupt operation of the seat, it is desirable that the suspension support mechanism includes a slowing portion configured to slow an operation of the link member in accordance with its closeness to an operation end of the link member.

In order to realize a simple movement of the chair, it is desirable that the leg includes a caster configured to rollably contact a floor surface. That is, as in Japanese Unexamined Patent Application Publication (Translation of PCT Application) No. 10-513374, if in the chair, an element that grips the floor surface due to a frictional force during sitting contacts the floor surface, there is a problem that the person cannot move while seated. In contrary thereto, in the present invention, it is less likely that a horizontal force is exerted on the caster even if the seat is in an inclined state during sitting, and thus no other elements are needed which generate the frictional force onto the floor surface, as a result of which the seated person can move while seated when necessary.

In order to realize the above-described behavior of the seat with the support mechanism of the seat alone, it is effective that the seat suspension support mechanism is configured to operably suspend and support a predetermined location of the seat in a front-rear direction and a left-right direction along a predetermined trajectory by suspending a part of the seat arranged above the leg from a part of the leg erected on a floor surface, and the suspension support mechanism has a seat inclining function of inclining a tip side in a movement direction of the seat downward when the seat moves from a reference position where the seat can be rested by its own weight.

Effect of the Invention

With the above-described configuration, the present invention can provide a chair in which the seated person can perceive a comfortable sitting feeling even if sitting for a long time, and a high work efficiency can stably be maintained.

MODE FOR CARRYING OUT THE INVENTION

Figure 1:
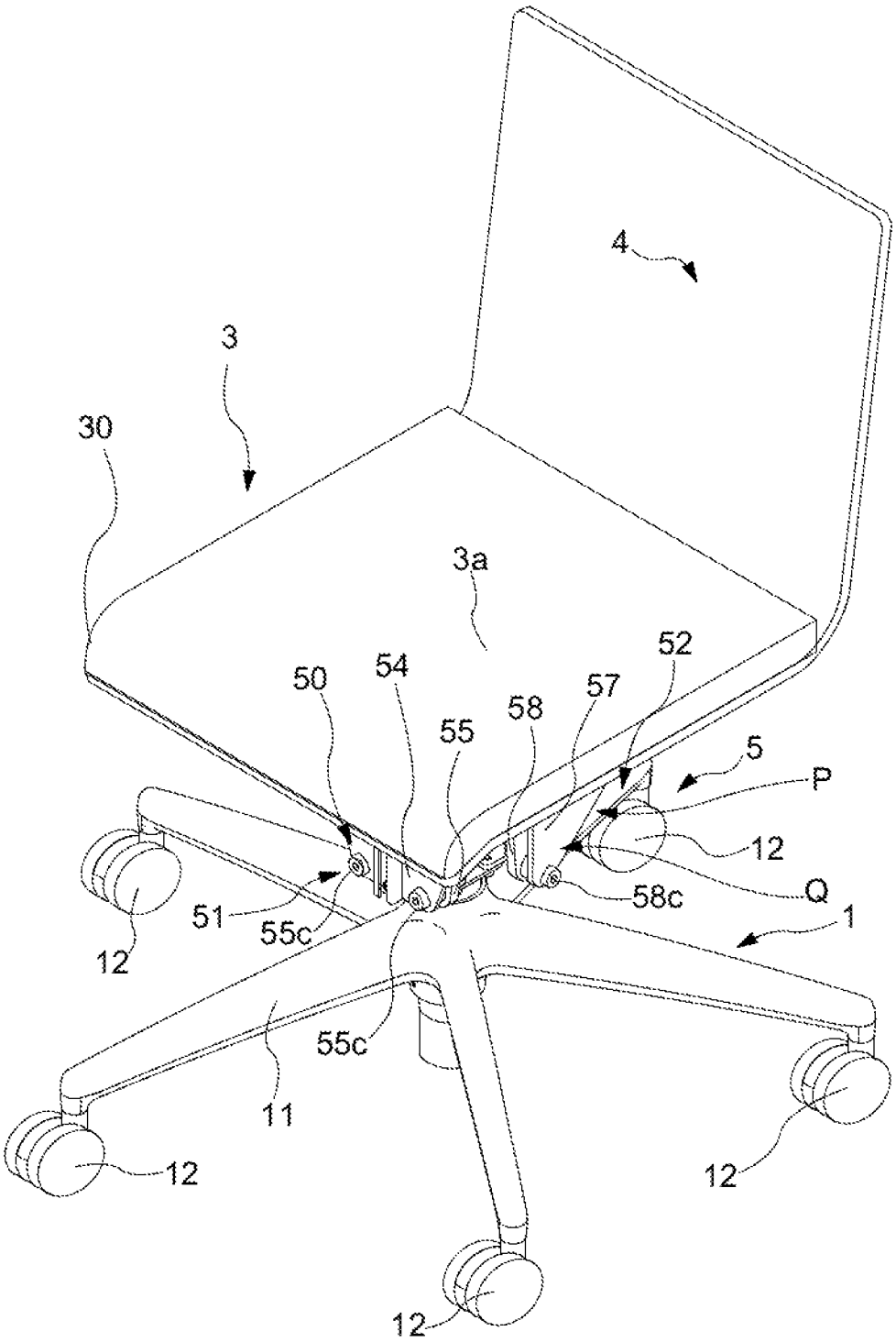
FIG. 1 is an appearance diagram according to a first embodiment of the present invention.
Figure 2:
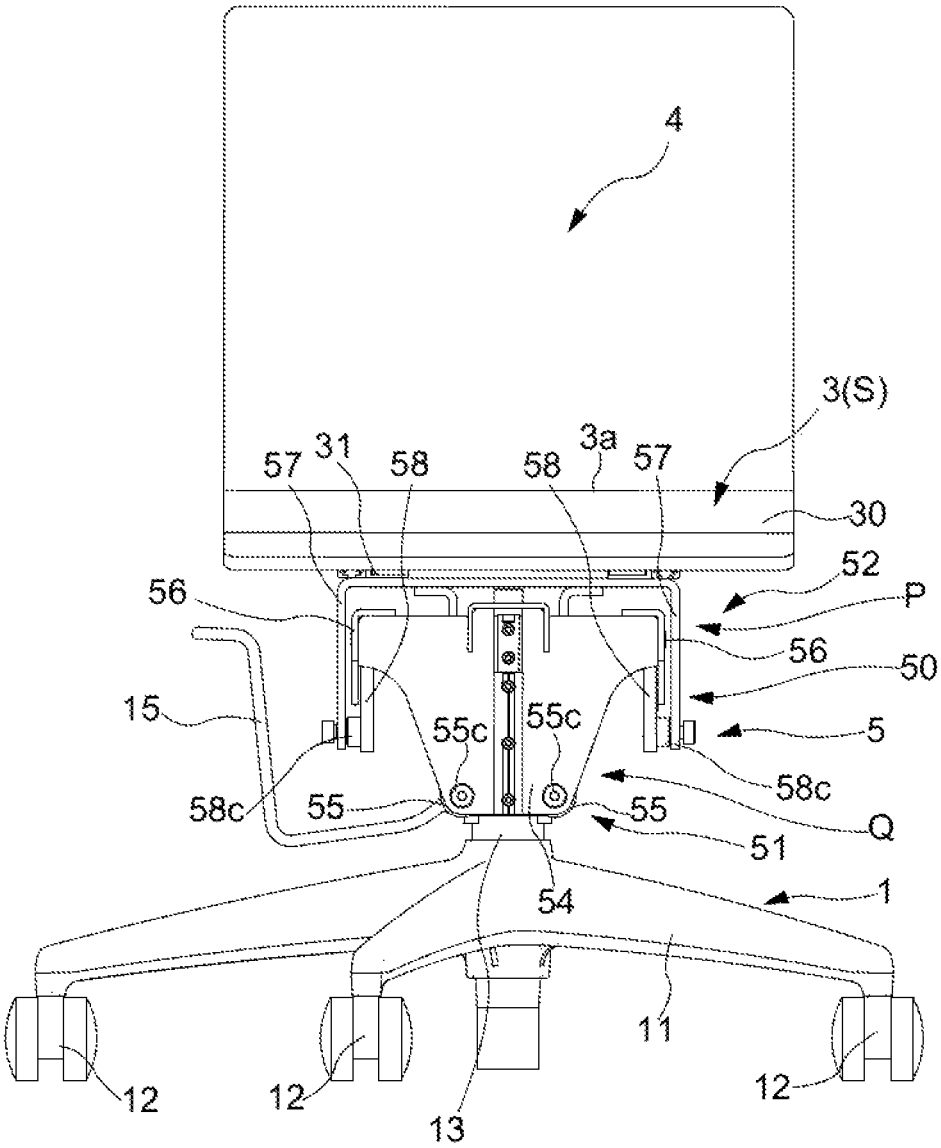
FIG. 2 is a front view according thereto.
Figure 3:
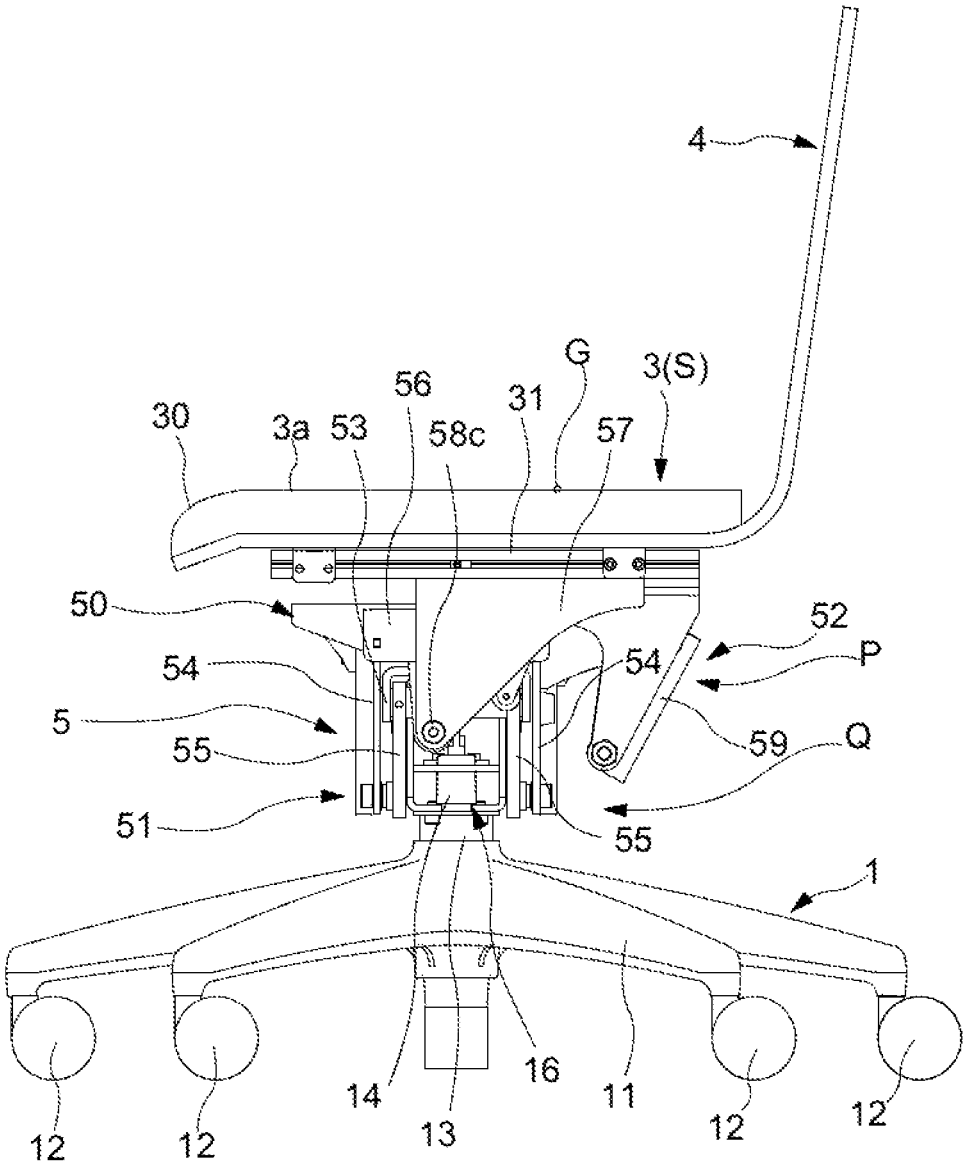
FIG. 3 is a side view according thereto.
Figure 4:
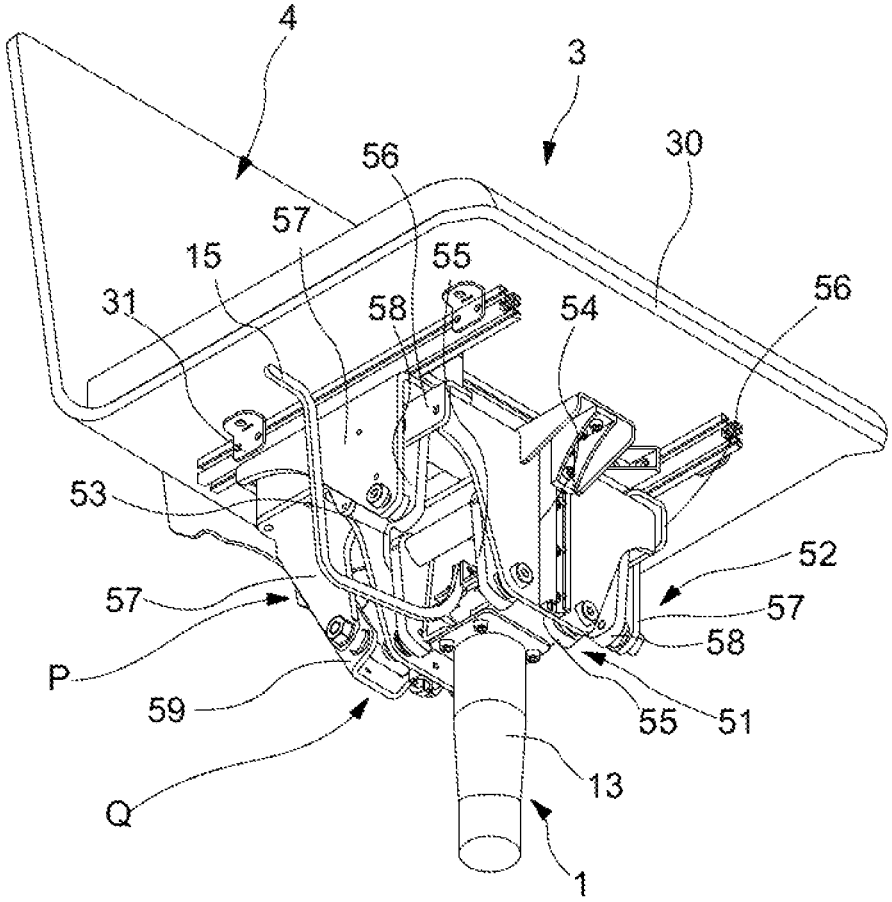
FIG. 4 is a perspective view of main parts according thereto.
Figure 5:
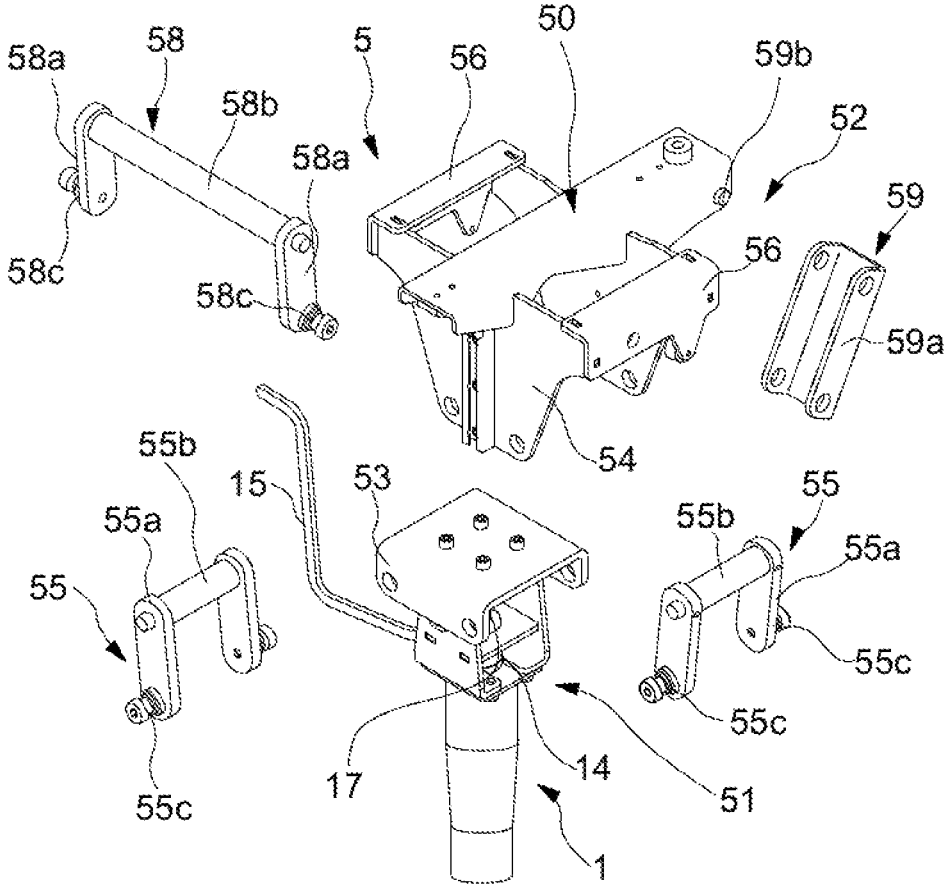
FIG. 5 is an exploded perspective view thereof.
Figure 6:
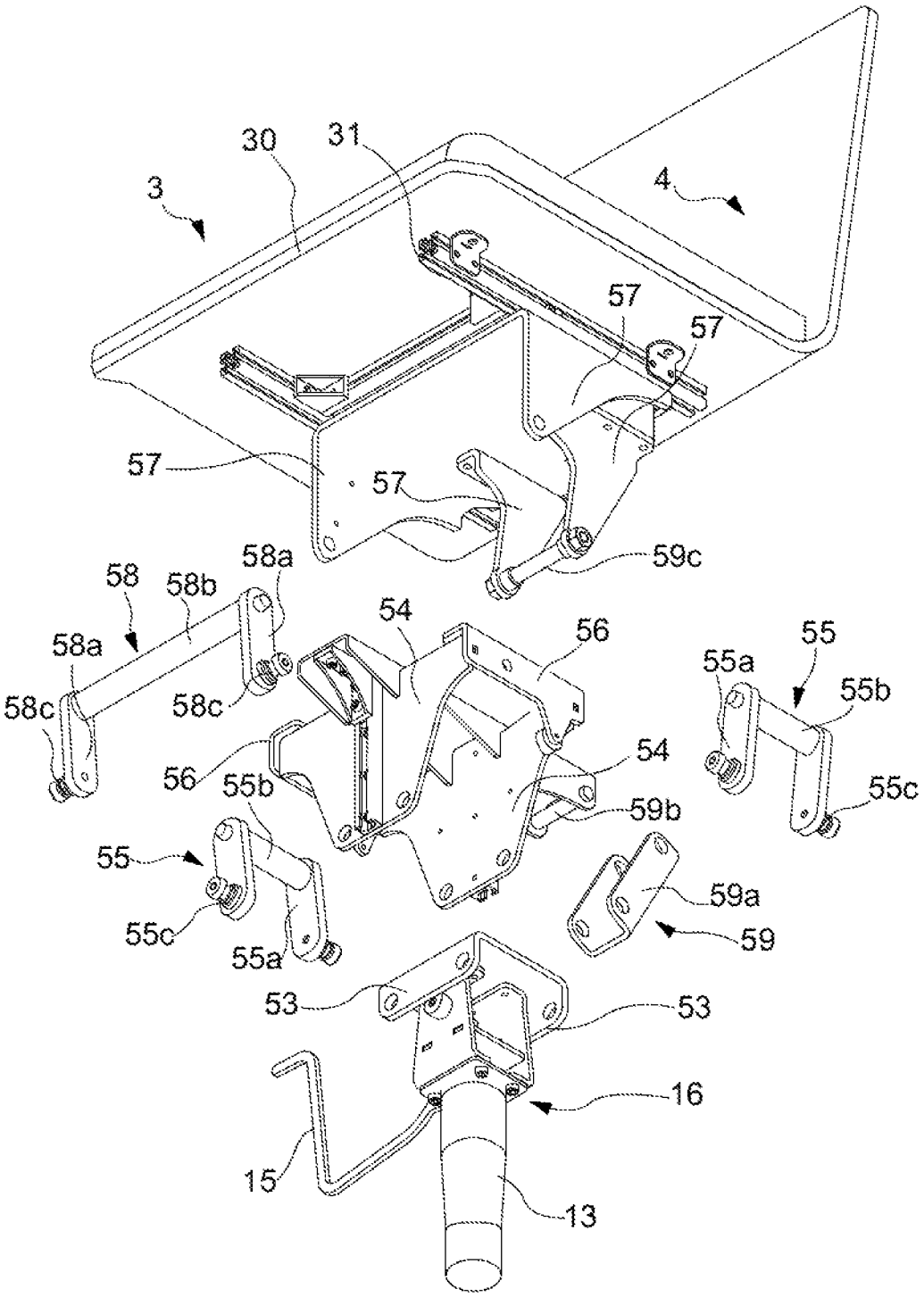
FIG. 6 is an exploded perspective view thereof.

Each of embodiments of the present invention will be described below with reference to the drawings.

First Embodiment

A chair according to a first embodiment of the present invention is referred to as an office rotating chair that can suitably be used in an office or at home.

As illustrated in FIG. 1 to FIG. 8, the chair mainly includes: a leg 1 erected on a floor surface, a seat 3 arranged above the leg 1, and a backrest 4.

The leg 1 includes: a leg vane 11 formed radially in planar view; a caster 12 attached to a bottom side of the leg vane 11 and rollably contacting the floor surface; a leg supporting post 13 erected on a center of the leg vane 11; a gas spring 14 being a lifting/lowering mechanism mounted within the leg supporting post 13 and configured to support the seat 3 in a lifting/lowering manner, a rotation support mechanism 16 configured to support, in the vicinity of an upper end of the leg supporting post 13, the seat 3 to permit horizontal rotation by allowing a rod of the gas spring 14 to relatively rotate with respect to the leg supporting post 13; and an operation lever 15 configured to adjust a vertical position of the seat 3 by pressing a push button 17 arranged at an upper end of the gas spring 14 to extend and shrink the gas spring 14.

In the present embodiment, the seat 3 is constructed mainly of a seat main body 30 of a plate shape formed integrally with the backrest 4, where a top surface of the seat main body 30 is a seat surface 3*a*, and a seat receiver 31 for supporting the seat 3 from below is attached on a bottom surface side of the seat main body 30.

Here, the chair according to the present invention is provided with the support mechanism 5 as the suspension support mechanism configured to operatively support the seat 3 in the front-rear direction and in the right-left direction, along a predetermined trajectory by suspending a part of the seat 3 from a part of the leg 1, the support mechanism 5 comprises a seat inclining mechanism Q being a seat inclining function configured to downwardly incline a tip side in the movement direction of the seat 3 when the seat moves from a reference position(S) where the seat can be rested by its own weight.

Further, the support mechanism 5 being the suspension support mechanism according to the present embodiment, to realize the behavior of the above-described seat 3 with the support mechanism 5 alone, is configured to operatively support the seat 3 in the front-rear direction and in the right-left direction, along a predetermined trajectory by suspending a part of the seat 3 from a part of the leg 1; and provided with the inclining mechanism Q being a seat inclining function for inclining a tip side in the operation direction of the seat 3 downwardly when the seat 3 is operated from a reference position(s) where the seat can be rested by its own weight.

As illustrated in FIG. 1 to FIG. 6, the support mechanism 5 is interposed between the leg 1 and the seat 3, and applies a link mechanism having link members 55, 58, and 59 extending in the up-down direction so that the seat 3 can be operatively supported along a predetermined trajectory along which a predetermined position of the seat 3 is operated in the front-rear direction and in the right-left direction. The support mechanism 5 is configured by the upper end portion of the leg 1, the lower end portion of the seat receiver 31, and a swing support body 50 interposed between the upper end portion of the leg 1 and the lower end portion of the seat receiver 31. The support mechanism 5 includes a left-right support unit 51 configured to operatively support the seat 3 in the right-left direction over the upper end portion of the leg 1 and the lower region of the swing support body 50, and a front-rear support unit 52 configured to operatively support the seat 3 in the front-rear direction over the lower end portion of the seat receiver 31 and the upper region of the swing support body 50. That is, the left-right support unit 51 and the front-rear support unit 52 overlap in the up-down direction at an overlapping position in planar view and are independently configured as a separate body at a position surrounding the leg supporting post 13 as the center in the plan view of the seat 3. In addition, in the present embodiment, the front-rear support unit 52 directly supports the seat 3 integrally configured with the backrest 4, and thus, in the present embodiment, configuration is that the backrest 4 is indirectly attached to the front-rear support unit 52; however, needless to say, configuration that the backrest 4 is directly attached on the upper half region of the swing support body 50 shall not be precluded.

The left-right support unit 51 includes a left-right swing unit 54 formed in a lower half region of the swing support body 50, a left-right suspension unit 53 configured to suspend and support the left-right swing unit 54 formed on the upper end of the leg 1, and a pair of left-right links 55 pivotally attached to the left-right swing unit 54 and the left-right suspension unit 53. The left-right link 55 includes a link main body 55*a* extending in the up-down direction, a suspension shaft 55*b* configured at the upper end of the link main body 55*a* to be pivotally attached onto the left-right suspension unit 53, and a swing shaft 55*c* configured at a lower end of the link main body 55*a* to be pivotally attached onto the left-right swing unit 54. Further, the pair of left-right links 55 is set so that a distance between the swing shafts 55*c* provided at the lower end of the left-right link 55 is shorter than a distance between the suspension shafts 55*b* provided at the upper end of the left-right link 55. Further, in the present embodiment, the right support structure and the left support structure are configured by the supporting location of the left-right link 55 and the left-right link 55.

The front-rear support unit 52 includes a front-rear swing unit 57 formed at a lower end of the seat receiver 31, a front-rear suspension unit 56 formed in an upper half region of the swing support body 50, the front-rear suspension unit 56 being for suspending and supporting the front-rear swing unit 57, and a front link 58 and a rear link 59 pivotally attached onto the front-rear swing unit 57 and the front-rear suspension unit 56. The front link 58 includes a front link main body 58*a* extending in the up-down direction, a front suspension shaft 58*b* configured at an upper end of the front link main body 58*a*, the front suspension shaft 58*b* being pivotally attached at a front side position of the front-rear suspension unit 56, and a front swing shaft 58*c* configured at a lower end of the front link main body 58*a*, the front swing shaft 58*c* being pivotally attached at a front side position of the front-rear swing unit 57. The rear link 59 includes a rear link main body 59*a* extending in the up-down direction, a rear suspension shaft 59*b* configured at an upper end of the rear link main body 59*a*, the rear suspension shaft 59*b* being pivotally attached to the front-rear suspension unit 56, and a rear swing shaft 59*c* configured at a lower end of the rear link main body 59*a*, the rear swing shaft 59*c* being pivotally attached to the front-rear swing unit 57. Further, the front link 58 and the rear link 59 are set so that a distance between the front swing shaft 58*c* and the rear swing shaft 59*c* provided at the lower end of the front link 58 and the rear link 59 is shorter than a distance between the front suspension shaft 58*b* and the rear suspension shaft 59*b* provided at the upper end of the front link 58 and the rear link 59. Further, in the present embodiment, the front support structure is configured by the front link 58 and the location at which the front link 58 is supported, and the rear support structure is configured by the rear link 59 and the location at which the rear link 59 is supported.

Further, in the present embodiment, in order to realize a more compact of the support mechanism 5, the front-rear support unit 52 and the left-right support unit 51 are provided to overlap in the up-down direction at an overlapping position in planar view.

Figure 7:
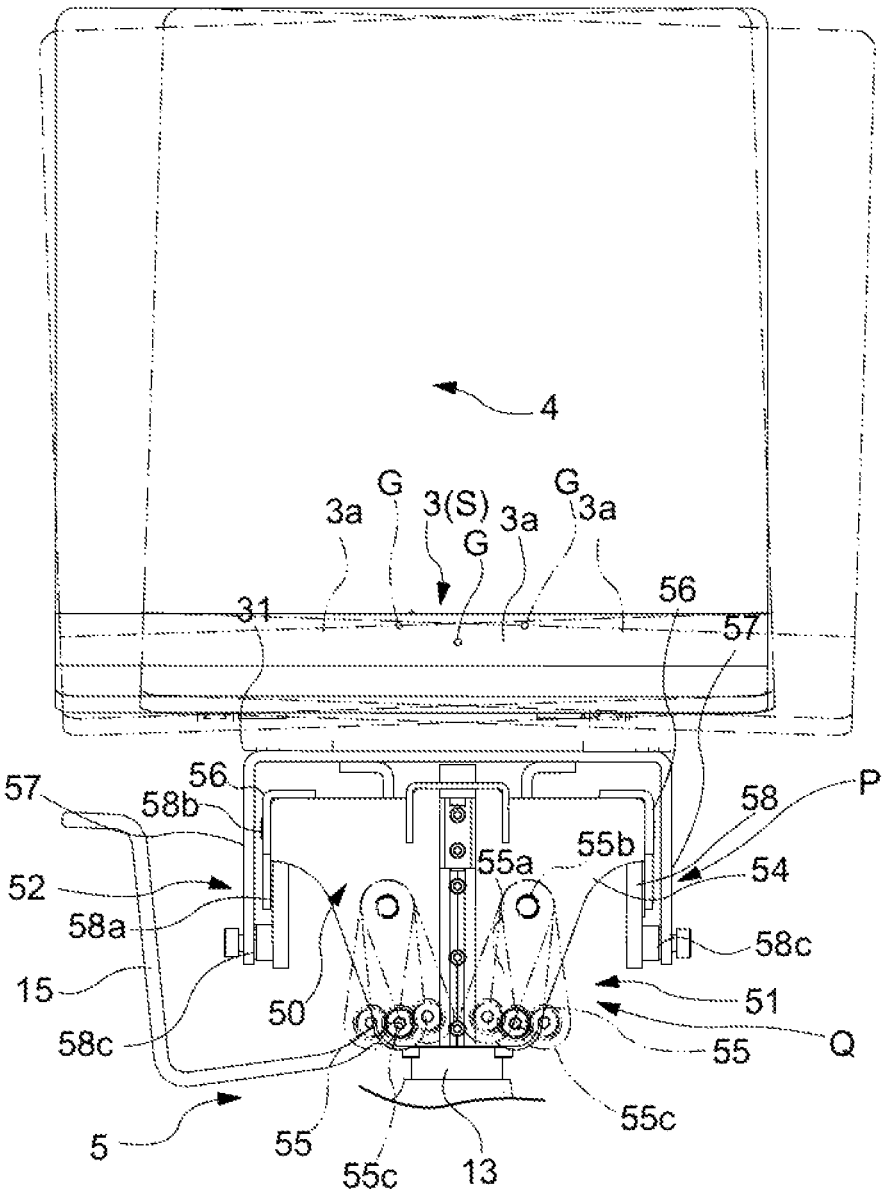
FIG. 7 is an operation explanatory diagram according thereto.
Figure 8:
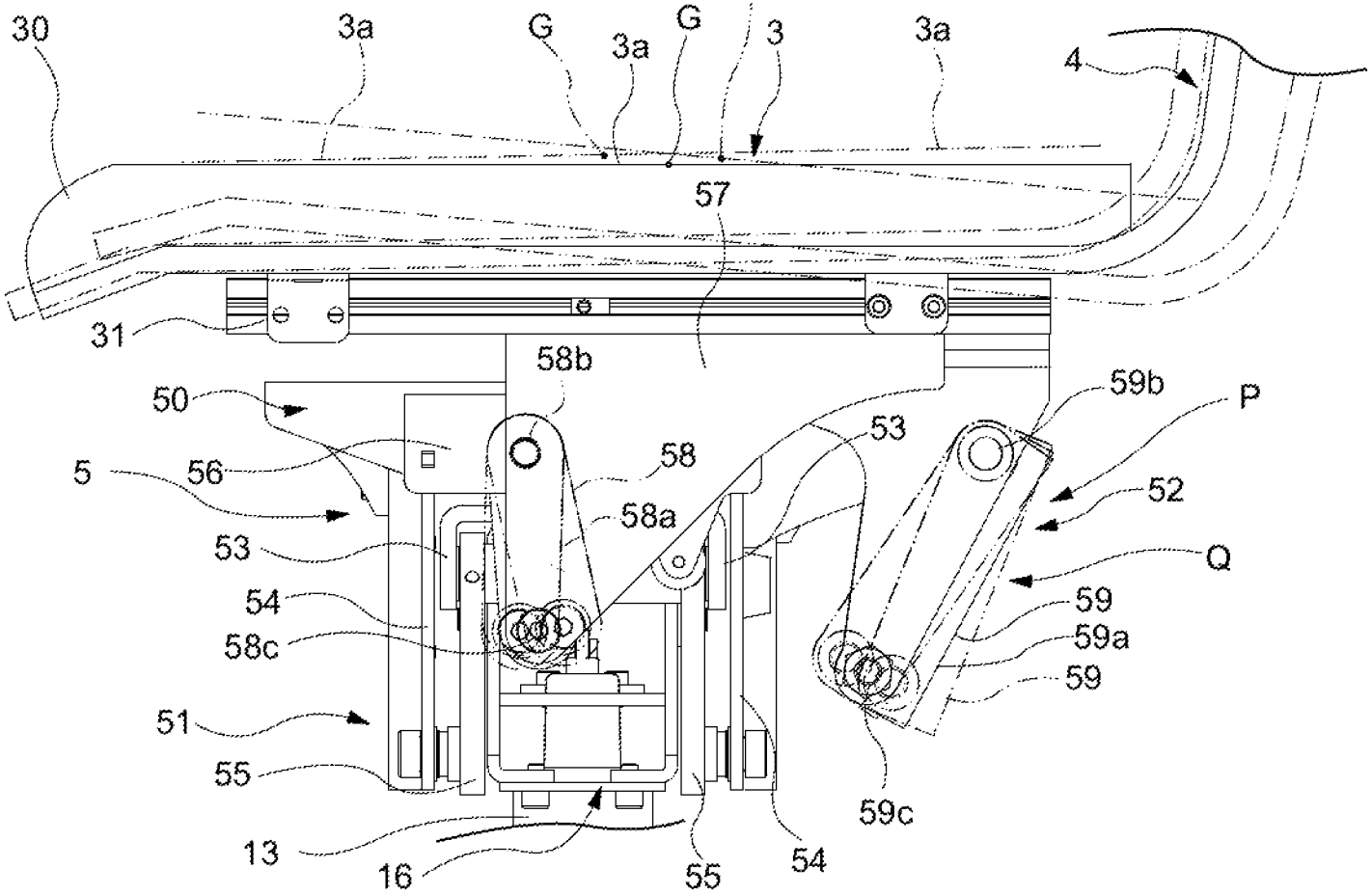
FIG. 8 is an operation explanatory diagram according thereto.

Here, in the present embodiment, particularly as illustrated in FIG. 7 and FIG. 8, it is so configured that the movement of the seat surface 3*a* swinging in the front-rear and right-left directions runs along a previously set predetermined trajectory by the effect of the left-right support unit 51 and the front-rear support unit 52.

FIG. 7 illustrates a behavior when the seat 3 operates in the right-left direction from the predetermined reference position (S) at which the seat 3 rests by its own weight. As illustrated in FIG. 7, when the seat surface 3*a* operates rightward and leftward by the left-right support unit 51, its operation is against the gravity. Specifically, when any or both of the swing shafts 55*c* provided at the lower end of the left-right link 55 are elevated, the position of the center of gravity G of the seat surface 3*a* rises from the reference position (S) indicated by a solid line. Further, at this time, a return force exerted by the gravity in a direction of returning the seat 3 to the reference position (S) is spontaneously applied to the seat 3. That is, in the present embodiment, the left-right link 55 is the left-right return unit, out of the return-force generation mechanism, configured to generate the return force in the right-left direction, and functions as the center-of-gravity movement mechanism P configured to elevate the center of gravity G of the seat 3 when the seat 3 operates from the reference position (S). In addition, the seat surface 3*a* operating rightward and leftward in FIG. 7 is in a posture in which the operation tip side is descended. As mentioned above, this results from the feature that the distance between the swing shafts 55*c* provided at the lower end of the left-right link 55 is set to be shorter than the distance between the suspension shafts 55*b* provided at the upper end of the left-right link 55. That is, in the present embodiment, the left-right link 55 also functions as the seat inclining mechanism Q.

FIG. 8 illustrates a behavior when the seat 3 operates in the front-rear direction from the predetermined reference position (S) at which the seat 3 rests by its own weight. As illustrated in FIG. 8 when the seat surface 3*a* operates forward and rearward by the front-rear support unit 52, its operation is against the gravity. Specifically, when any or both of the front swing shaft 58*c* and the rear swing shaft 59*c* provided at the lower end of the front link 58 and the rear link 59 are elevated, the position of the center of gravity G of the seat surface 3*a* elevates from the reference position (S) indicated by the solid line. Further, at this time, a return force exerted by the gravity in a direction of returning the seat 3 to the reference position (S) is spontaneously applied to the seat 3. That is, in the present embodiment, the front link 58 and the rear link 59 correspond to the front-rear return unit, out of the return-force generation mechanism, configured to generate the return force in the front-rear direction, and functions as the center-of-gravity movement mechanism P configured to elevate the center of gravity G of the seat 3 in accordance with the operation of the seat 3 from the reference position (S). In addition, in FIG. 8, the seat surface 3*a* operating forward and rearward takes a posture in which the operation tip side is descended. As described above, this results from the feature that the distance between the front swing shafts 58*c* and the rear swing shaft 59*c* provided at the lower end of the front link 58 and the rear link 59 is set to be shorter than the distance between the front suspension shaft 58*b* and the rear suspension shaft 59*b* provided at the upper end of the front link 58 and the rear link 59. That is, in the present embodiment, the front link 58 and the rear link 59 also function as the seat inclining mechanism Q.

That is, in the present embodiment, the seat inclining mechanism Q and the center-of-gravity movement mechanism P being a return-force generation mechanism are configured by the pair of left-right links 55, the front link 58, and the rear link 59 included in the support mechanism 5.

<Modification>

Figure 9:
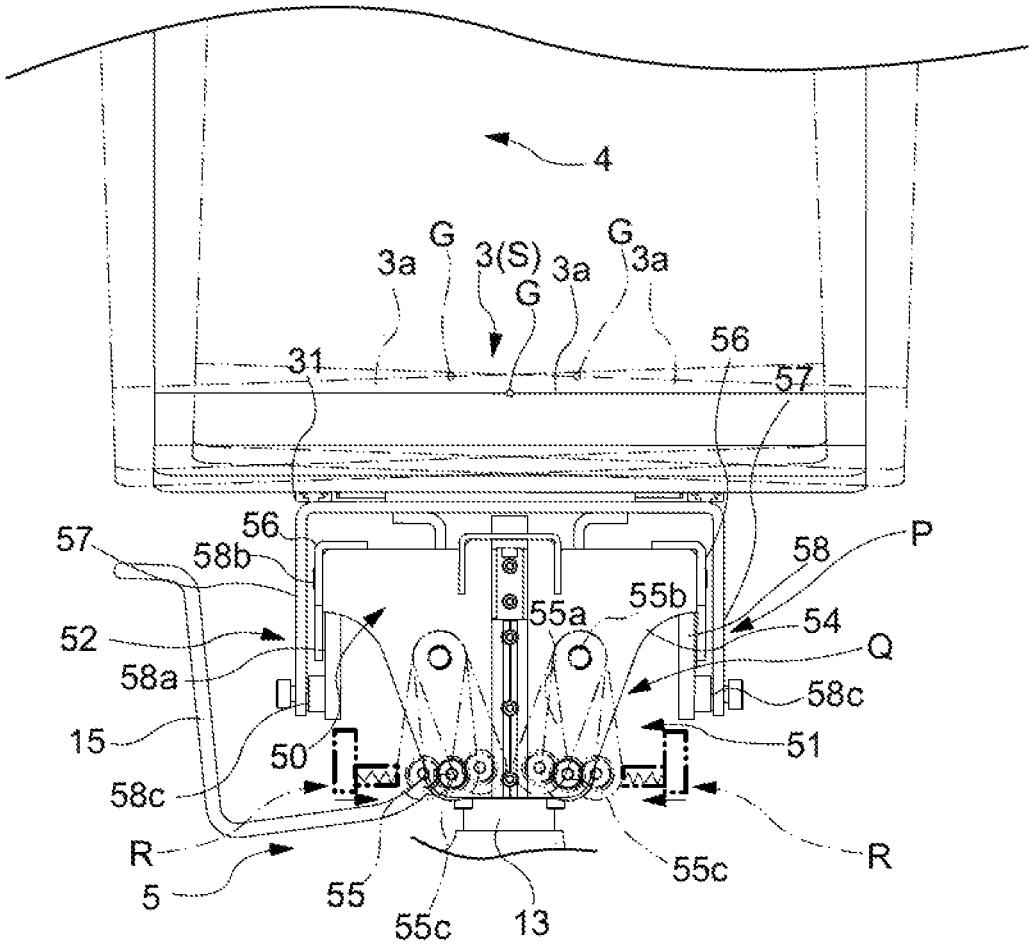
FIG. 9 is an operation explanatory diagram according to a modification of the first embodiment.

FIG. 9 illustrates an example in which the shockless unit R disclosed in the first embodiment is applied. That is, in the shockless unit R, an elastic means abuts against the left-right link 55 in the vicinity of the operation terminal end of the left-right link 55 so that a collision between the constituent elements can be avoided. Needless to say, the position at which the elastic means is provided is not limited to the outside of the left-right link 55. The elastic member may be provided inside the left-right link 55 and may be configured to come into contact with other constituent elements operating along with the seat.

Further, although not illustrated, when attempting to provide that which includes the shockless portion R and a slowing portion configured to slow an operation of the link members 55, 58, 59 in accordance with its closeness to operation end of the link members 55, 58, 59, disclosed in the embodiments described above by a mode different from the above-described mode, components such as a rotary damper may be separately installed in the link members 55, 58, and 59. That is, when a component such as a rotary damper is installed, it is possible to effectively avoid slowing down of the operation toward the operation end of each of the link members 55, 58, and 59 and a collision with other constituent elements of the chair at the operation end.

Thus, the chair according to the present embodiment and modification comprises the support mechanism 5 as the suspension support mechanism configured to operatively support the seat 3 in the front-rear direction and the left-right direction along a predetermined trajectory by suspending a part of the seat 3 from a part of the leg 1, and the support mechanism 5 comprises the seat inclining mechanism Q being a seat inclining function configured to downwardly incline a tip side in the movement direction of the seat 3 when the seat moves from a reference position(S) where the seat can be rested by its own weight.

With the configuration described above, the chair according to the present embodiment not only follows the operation of the lumbar region and the gluteal region performed unconsciously by the seated person during sitting in order to maintain comfort, but also the seated person on the seat configured to be operable by being suspended and supported performs an operation of returning to an initial posture while maintaining the comfort or other operations. As a result, the chair according to the present embodiment provides comfort resulting from a natural operation for a human body. In other words, by considering the tendency of movement resulting from a body structure of the seated person during sitting, a chair which can suitably support the operation is achieved. In particular, focusing on repeating the operation of returning to a reference position after the seated person changes the posture from the reference position, by supporting such operation reasonably in a natural state, as a result, the seated person to perceive a comfortable sitting feeling, even if sitting for a long time, and further allows the seated person to stably maintain a high work efficiency.

In addition, in the present embodiment, the leg 1 includes a lifting and lowering mechanism having the gas spring 14, the seat 3 is provided above the lifting and lowering mechanism, and the support mechanism 5 is interposed between the lifting and lowering mechanism and the seat 3, and thus, a compact configuration is realized, instead of a complicated structure in which the support mechanism 5 is merged with the lifting and lowering mechanism.

Further, in the present embodiment, the support mechanism 5 is configured as the suspension support mechanism applying a configuration of the link mechanism having the link members 55, 58, and 59 extending in the up-down direction, and thus, a smooth operation in accordance with the movement of the seated person is effectively realized.

In particular, in the present embodiment, the seat inclining mechanism Q is constituted to incline the operated seat 3 by setting the distance between the lower ends of the plurality of link members 55, 58, 59 are set shorter than the distance between the upper ends, and thus, providing the seated person a comfortable sitting feeling without adding particular components is realized.

Further, in the present embodiment, the support mechanism 5 includes the front-rear support unit 52 configured to operatively support the seat 3 in the front-rear direction and the left-right support unit 51 provided separately from the front-rear support unit 52 and configured to operatively support the seat in the left-right direction, and thus, the seated person can more precisely set the operation range in which the seat 3 can be operated.

In addition, in the present embodiment, by providing the front-rear support portion 52 and the left-right support portion 51 so that the up-and-down positions overlap at a position surrounding the center of the seat 3, a more compact chair in a planar view is realized.

Further, the front-rear support unit 52 is arranged above the left-right support unit 51, and thus, the behavior of the seated person performing a greater and more frequent operation in the front-rear direction than that in the left-right direction can be further followed.

In the modification described above, the support mechanism 5 includes the shockless unit R configured to avoid and absorb a shock caused by a collision between the end of the link members 55, 58, and 59 at the operation end, and thus, an undesirable shock and noise due to the abrupt operation of the seat 3 are not inflicted on the seated person.

Further, in the modification described above, if the support mechanism 5 has the slowing portion configured to slow an operation in accordance with its closeness to an operation end of the link members 55, 58, 59 with a component such as a rotary damper and thus, it is possible to effectively avoid a situation in which the seated person is given an undesirable "fear" or discomfort due to an unintended abrupt operation of the seat 3.

In addition, in the present embodiment, the leg 1 includes the casters 12, and thus, it is possible to prevent the chair from easily moving even if the seat 3 operates forward, rearward, rightward, or leftward while the seated person can move together with the chair while being seated when required. This eliminates an element for gripping the floor surface by frictional force to operate the seat 3 during sitting is not required, unlike in Japanese Unexamined Patent Application Publication (Translation of PCT Application) No. 10-513374.

Particularly, in the present embodiment, in order to realize the above-described behavior of the seat 3 with the support mechanism 5 alone, the support mechanism 5 is configured to move the supporting locations to the seat 3 to the front, rear, right, and left by combining the front support structure including the link 58 and the rear support structure including the rear link 59, configured to directly or indirectly support the bottom surface of the seat 3 at two locations in the front-rear direction, and the left support structure and the right support structure including the left and right links 55, configured to directly or indirectly support the bottom surface of the seat 3 at two locations in the left-right direction, the supporting locations being configured to draw a trajectory along which the tip side in a movement direction of the seat 3 is downwardly inclined in accordance with the movement, and the support mechanism 5 further includes a return-force generation mechanism configured to generate, in accordance with the amount of movement, the return force in the direction of returning the supporting locations to the seat 3 having moved from the reference position (S) in the front-rear or left-right direction, to the reference position (S).

As a specific mode of an implementation, in the present embodiment, a configuration so that, as the front-rear supporting locations supported by the front-rear the links 58, 59 are moved in the front direction from the reference position (S), the front link 58 supporting location is relatively lower than the rear link 59 supporting location, and as the front-rear supporting locations are moved in the rear direction from the reference position (S), the rear-side supporting location of the seat 3 is relatively lower than the front-side supporting location, is applied. Alternatively, a configuration so that as the left-right supporting locations supported by the left-right link 55 are moved in the left direction from the reference position (S), the left-side supporting location is relatively lower than the right-side supporting location, and as the left-right supporting locations are moved in the right direction from the reference position (S), the right-side supporting location of the seat 3 is relatively lower than the left-side supporting location, is applied.

A modification of the present invention, as well as other embodiments, will be described below. In the following modifications and embodiments, elements corresponding to constituent elements of the embodiment described above will be referred to by the same reference numerals and detailed description thereof will be omitted.

Second Embodiment

A chair according to a second embodiment of the present invention, the illustration of the backrest 4 is omitted to further clarify the configuration of the seat 3 and the position of the seat surface 3*a*; however, it is not intended to exclude assembling of the backrest 4.

The chair is similar to that in the above-described embodiments in that the leg 1 coming in contact with the floor surface and the seat 3 provided above the leg 1 are provided. Further, the seat 3 has a substantially exact circular shape in planar view different from that in the above-described embodiments, and the backrest 4 is not integrally formed as described above. However, the configuration of the seat 3 is similar to that in the above-described embodiments and the conventional configuration in that the seat main body 30 is used as a main body while the top surface side is the seat surface 3*a* and the seat receiver 31 is provided on the bottom surface side.

Further, the leg 1 has a configuration similar to that in the above-described embodiments, and thus, description will be omitted. The chair according to the present embodiment is similar to that in the embodiments described above in that the support mechanism is configured across the upper end portion of the leg 1 to the lower end portion of the seat receiver 31.

However, in the chair according to the present embodiment, when the configuration of the support mechanism is differed from that in the above-described embodiments, the return-farce generation mechanism and the seat inclining mechanism Q are configured in a different mode.

That is, the chair according to the present embodiment is common to the above-described embodiment in that the suspension support mechanism configured to operatively support the seat 3 in the directions including the front-rear direction and the left-right direction along a predetermined trajectory by suspending a part of the seat 3 from a part of the leg 1 is the link mechanism including the link member extending in the up-down direction. However, the chair according to the present embodiment is different from the suspension support mechanism according to the above-described embodiment in that the link member is a both-end universal joint 72 being a universal joint of which the both ends are operatively supported both in the directions including the front-rear direction and in the left-right direction. Further, in the present embodiment, when a joint support mechanism 7 allowing the seat 3 and the leg 1 to be coupled via the both-end universal joints 72 is provided, the seat is configured to be operable in the directions including the front-rear direction and the left-right direction.

Figure 10:
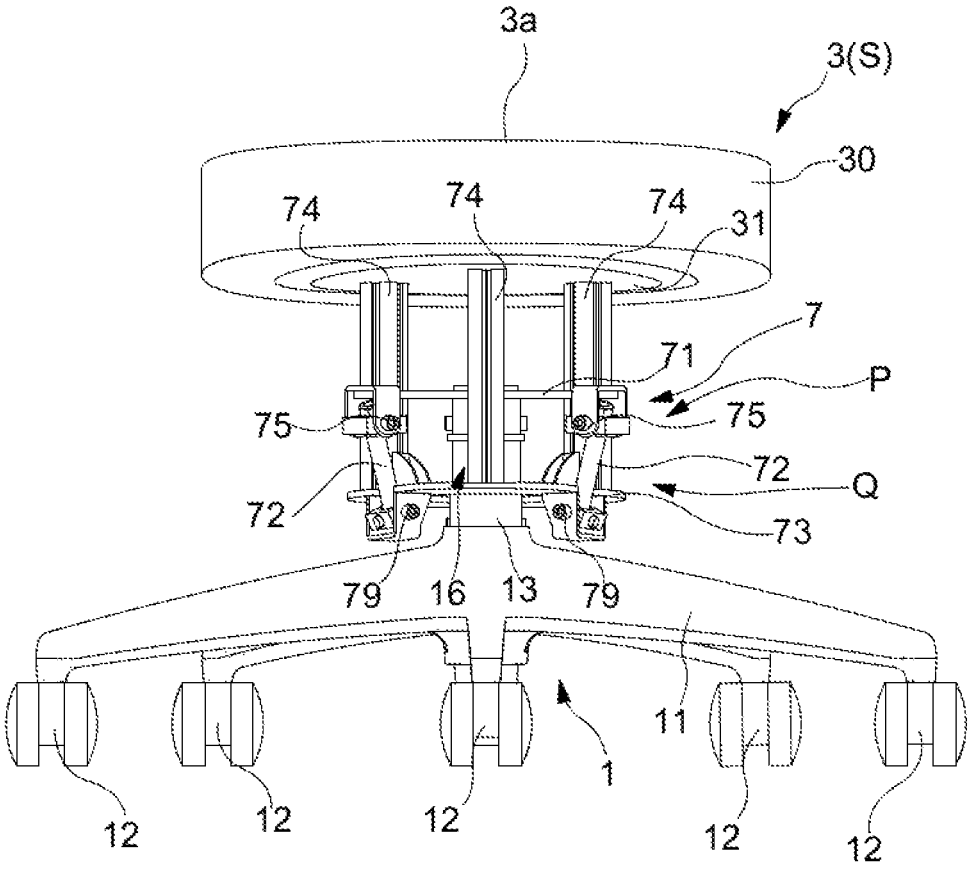
FIG. 10 is an appearance diagram according to a second embodiment of the present invention.
Figure 11:
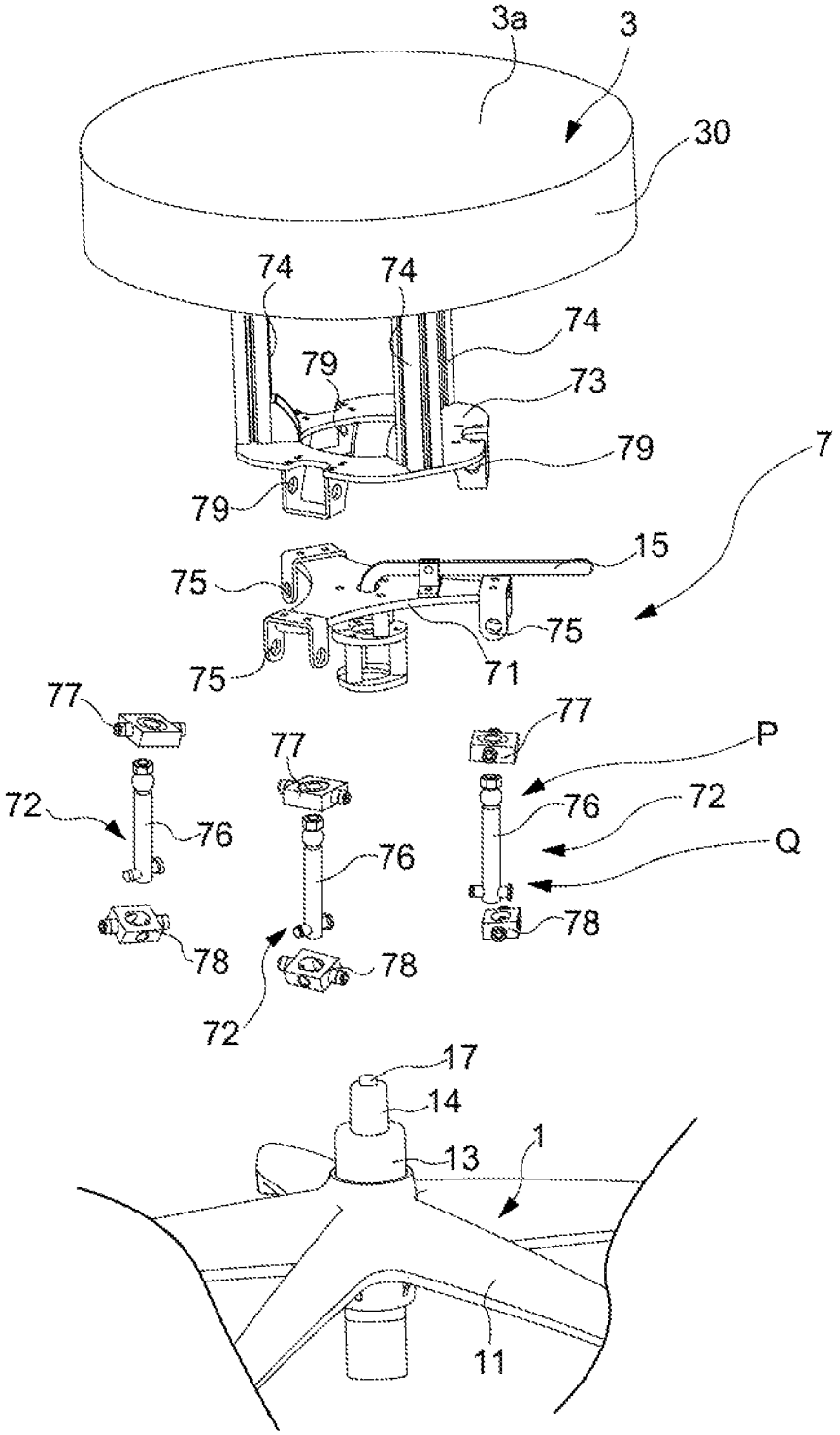
FIG. 11 is an exploded perspective view according thereto.
Figure 12:
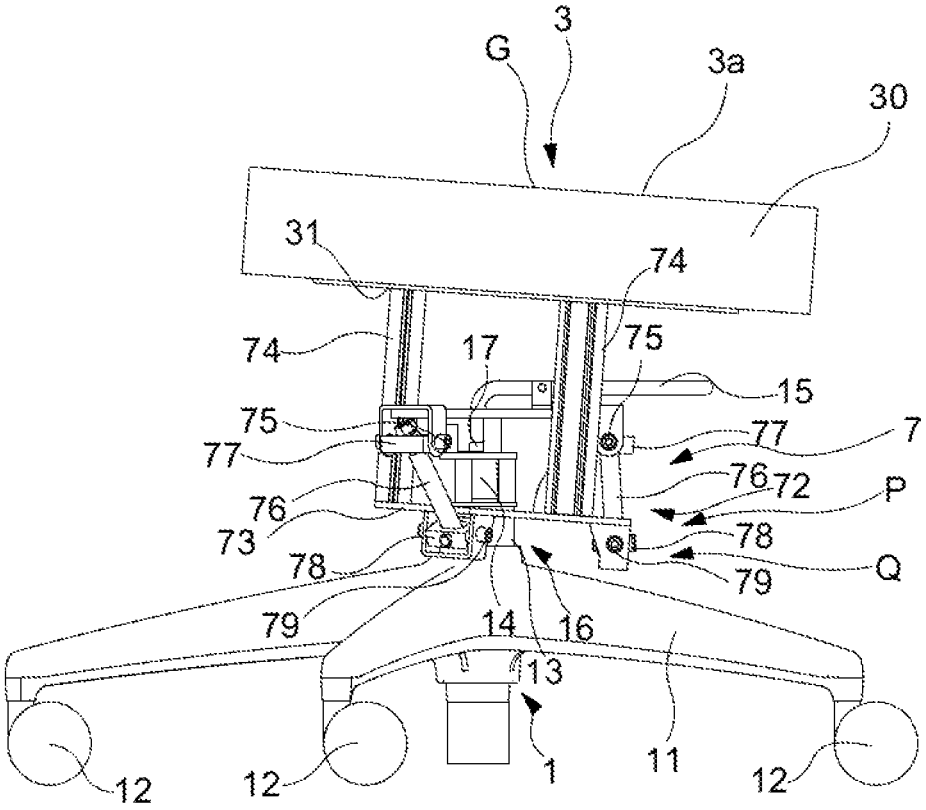
FIG. 12 is an operation explanatory diagram according thereto.

As illustrated in FIG. 10 to FIG. 12, the joint support mechanism 7 is interposed between the leg 1 and the seat 3, and applies the link mechanism having the both-end universal joints 72 being link members extending in the up-down direction so that the seat 3 can be operatively supported along a predetermined trajectory along which the seat 3 is operated in the directions including the front-rear direction and in the left-right direction. The joint support mechanism 7 is configured to be interposed between the upper end portion of the leg 1 and the lower end portion of the seat receiver 31.

The joint support mechanism 7 includes a suspension board 71 provided in an upper end portion of the leg 1, the both-end universal joints 72 of which the upper end portion is connected to the suspension board 71, a swing board 73 connected to a lower end portion of the both-end universal joints 72, and a seat support post 74 erected on the swing board 73 and configured to support the seat 3 at a height position higher than the suspension board 71.

The suspension board 71 is fixed to the upper end of the leg 1 and forms an annular shape in planar view around the leg supporting post 13. In the suspension board 71, portions at three locations on the outside are suspended, and the suspended portions are punched with an upper connection hole 75 for connecting to the upper end of the both-end universal joints 72.

In the both-end universal joints 72 being three link members, the upper end portion is attached to be suspended down from the upper connection hole 75 of the suspension board 71, and the lower end portion is connected to the swing board 73. The both-end universal joints 72 includes a joint main body 76 extending in the up-down direction, an upper connection unit 77 configured at the upper end of the joint main body 76, the upper connection unit being pivotally attached onto the suspension board 71, and a lower connection unit 78 configured at the bottom end of the joint main body 76, the lower connection unit being pivotally attached onto the swing board 73. Further, in the three both-end universal joints 72 being link members, a distance between the lower connection units 78 provided at the lower end is set to be shorter than a distance between the upper connection units 77 provided at the upper end.

The swing board 73 is in a board-like shape of an annular shape in planar view around the leg supporting post 13 suspended and supported onto the suspension board 71 via the both-end universal joints 72, and includes a lower connection hole 79 configured to connect to the lower connection unit 78 provided at the lower end of the both-end universal joints 72 at three locations on the outer circumference surface.

The seat support post 74 is configured so that the lower end portions are each fixed at three locations on the top surface of the swing board 73, it stands upwardly in a substantially vertical direction at the reference position (S) at which the seat 3 does not make any operation, and the upper end portions are fixed to the seat receiver 31. That is, the seat 3 is configured so that the vertical thicknesses are substantially constant as illustrated, and thus, the top surface of the swing board 73 and the seat surface 3*a* are configured to substantially face in the same direction. Further, the seat support 74 is arranged at a substantially intermediate position between the both-end universal joints 72, so that when the seat support post 74 operates, it does not interfere with the both-end universal joints 72 itself and the operation thereof.

An operation of the seat according to the present embodiment will be described, below. FIG. 10 illustrates a predetermined reference position (S) at which the seat 3 rests by its own weight, and FIG. 12 illustrates a behavior of the seat 3 when the seat 3 operates into any direction. Not only in a state illustrated in FIG. 12, but also when the seat 3 operates from the reference position (S) into any direction, its operation is against the gravity. Specifically, when any or all of the lower connection units 78 provided at the lower end of the both-end universal joints 72 are elevated, the position of the center of gravity G of the seat surface 3*a* rises from the reference position (S). At this time, the return farce exerted by the gravity in a direction of returning the seat to the reference position (S) is spontaneously applied to the seat. That is, in the present embodiment, the both-end universal joint 72 is the return-force generation mechanism, and functions as the center-of-gravity movement mechanism P configured to elevate the center of gravity G of the seat 3 in accordance with the operation of the seat 3 from the reference position (S). In addition, as illustrated in FIG. 12, the seat surface 3*a* that has operated takes a posture in which the operation tip side is always descended. This results from the feature, as described above, that the distance between the lower connection units 78 provided at the lower end of the both end universal joints 72 is set to be shorter than the distance between the upper connection units 77 provided at the upper end of the both-end universal joints 72. That is, in the present embodiment, the both-end universal joint 72 also functions as the seat inclining mechanism Q.

As described above, also in accordance with the second embodiment of the present invention, it is possible to accomplish the operation and effect similar to those in the first embodiments described above.

In particular, in the present embodiment, as a mode of the suspension support mechanism, the link members are configured as the both-end universal joints 72 of which the both ends are pivotably supported in the directions including the front-rear direction and right-left direction, and the seat and the leg 1 are coupled via the both-end universal joints 72. This enables a more flexible operation which can further improve the followability to the movement of the seated person.

Further, in the present embodiment, when a plurality of both-end universal joints 72 being link members are arranged so that the up-and-down positions overlap at a position surrounding the center of the seat 3 in planar view, a chair configured to be more compact in the up-down direction is realized.

Further, in the present embodiment, when the configuration is applied in which the seat 3 is suspended by the three both-end universal joints 72 being link members, it is possible to minimize wobbling of the supported seat 3, as a result of which the seated person is given a more comfortable sitting feeling. It is noted that, the present embodiment does not exclude a configuration in which the four or five or more both-end universal joints 72 being link members are provided to realize a more stable support for the seat 3.

[Modification]

Modifications of the present embodiment will be described below as illustrated in the FIG. 13.

A chair according to the present modification, more specifically illustrate a configuration for attaching the seat receiver 31 and the backrest 4, while substantially following the configuration of the joint support mechanism 7 above described.

That is, the chair is similar to that in the above-described embodiment in that the leg 1 coming in contact with the floor surface and the seat 3 provided above the leg 1 are provided. Further, the seat 3 is not formed integrally the backrest 4 as above described.

Figure 13:
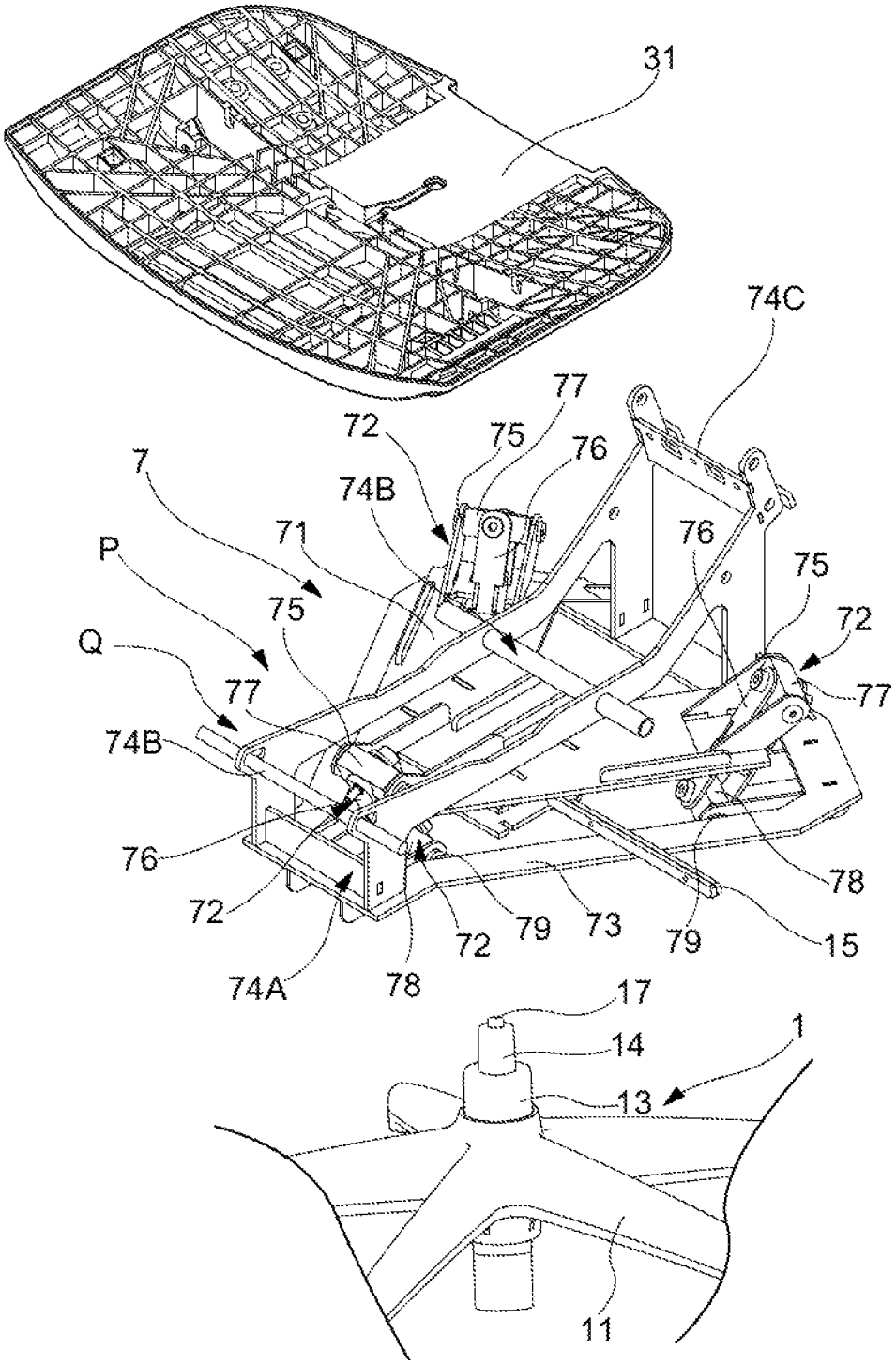
FIG. 13 is a configuration explanatory diagram according to a modification of the second embodiment.

As illustrated in FIG. 13, similarly to that in the second embodiments above-described, the joint support mechanism 7 is interposed between the leg 1 and the seat 3 and applies a link mechanism having, both-end universal joints 72 being link members extending in the up-down direction so that the seat 3 is operatively supported along a predetermined trajectory along which the seat 3 is operated in the directions including the front-rear direction and in the right-left direction. The joint support mechanism 7 is configured to be interposed from an upper end portion of the leg 1 to a lowering end portion of the seat receiver 31.

The joint support mechanism 7 includes a suspension board 71 provided in an upper end portion of the leg 1, the both-end universal joints 72 of which the upper end portion is connected to the suspension board 71, and the swing board 73 connected to a lower end portion of the both-end universal joints 72.

Here, in the present modification, further, instead of the seat support post 74 according to the above embodiment, a backrest and seat attaching part 74A erected on the swing board 73 and configured to support the seat 3 and the backrest 4 at a height position higher than the suspension board 71 is provided.

The suspension board 71 is fixed to a horizontally rotatable location at the upper end of the leg 1 by the rotation support mechanism 16 provided in the leg 1 and forms a substantially triangular annular shape in planar view around the leg supporting post 13. In the suspension board 71, a part of the three locations at the corner portion are raised obliquely upward, and the suspended portions are punched with an upper connection hole 75 for connecting to the upper end of the both-end universal joints 72. Further, in the present embodiment, the suspension board 71 is formed so that the constituent elements of the leg 1 illustrated on the lower part at the center in the planar view of the suspension board 71 can be assembled and a push button 17 of a gas spring 14 that can operate the operation lever 15 is assembled.

In the both-end universal joints 72 being three link members, the upper end portion is attached to be suspended down from the upper connection hole 75 of the suspension board 71, and the lower end portion is connected to the swing board 73. The both-end universal joints 72 includes a joint main body 76 extending in the up-down direction, an upper connection unit 77 pivotally attached at the upper end of the joint main body 76, the upper connection unit being further pivotally attached onto the suspension board 71, and a lower connection unit 78 pivotally attached at the bottom end of the joint main body 76, the lower connection unit being further pivotally attached onto the swing board 73. Further, in the three both-end universal joints 72 being link members, a distance between the lower connection units 78 provided at the lower end is set to be shorter than a distance between the upper connection units 77 provided at the upper end. Here, in the present modification, the direction in which the joint main body 76 is pivotally attached onto the upper and lower connecting units 77 and 78, and the direction in which the upper and lower connecting units 77, 78 are pivotally attached onto the suspension board 71 and the swing board 73 are orthogonal to each other in planar view. As a result, the both-end universal joints 72 according to the present modification, can smoothly operate in all directions in planar view.

The swing board 73 is a board-like shape of a triangular annular shape in planar view around the leg supporting post 13 suspended and supported onto the suspension board 71 via the both-end universal joints 72, and includes a lower connection hole 79 configured to connect to the lower connection unit 78 provided at the lower end of the both-end universal joints 72 at three locations on the outer circumference surface.

The backrest and seat attaching part 74 A is provided so as to straddle the suspension board 71 in the front-rear direction from the front and rear two locations on the top surface of the swing plate 73. And a seat attaching part 74B for operably attaching the seat receiver 31 is provided at a position ranging from the center in the front-rear direction to the front end of backrest and seat attaching part 74A, and a backrest attaching portion 74C for attaching the backrest 4 is provided on the rear-side.

An operation of the seat 3 in the present modification, similarly to that in the embodiments above-described, when the seat 3 operates from the reference position (S) in any direction, is the reference a center-of-gravity moving mechanism P as a returning force generating mechanism rising the position of the center of gravity G of the seat surface 3*a* from the position (S) is realized by the both-end universal joints 72. In addition, also in the present modification, in the both-end universal joints 72, a distance between the lower connection units 78 provided at the lower end is set to be shorter than a distance between the upper connection units 77 provided at the upper end, as a result, the both-end universal joints 72 also functions as the seat inclining mechanism Q.

As described above, also in accordance with the present modification of the present embodiment, it is possible to accomplish the operation and effect similar to those in the above-described embodiments.

In particular, in the present modification, by providing the backrest and seat attaching part 74A to attach the seat 3 and a backrest 4 each independently, in addition to the flexible operation similar to the above-described embodiment, the seat 3 and the backrest 4 can also perform highly compliant operation in accordance with the posture of the seated person, so that the seated feeling of the seated person can be further improved.

Thus, an embodiment of the present invention has been described, and a specific configuration of each unit is not limited to that in the embodiments described above and various modifications are possible without departing from the gist of the present invention.

For example, in the above-described embodiments, only a mode in which the backrest is provided integrally with the seat is disclosed; however, naturally, a mode in which the backrest is provided separately from the seat, and a mode in which while the seat and the backrest are provided separately, a synchro-tilt mechanism in which the backrest may operate in response to the operation of the seat are provided may also be acceptable. In particular, when the backrest is provided in the front-rear support unit and/or the seat, it is possible to obtain the synchro-tilt mechanism with a simple configuration.

Further, a bending function of bending the front portion of the seat may be provided, and in association with the front-rear support unit, the seat may be supported at three locations in the front-rear direction.

Further, although an elbow is not disclosed in each of the embodiments described above, of course, provision of the elbow shall not be precluded in each of the embodiments described above. In particular, in a case of a chair directly or indirectly provided with the elbow in the vicinity of the upper end of the leg, the elbow does not operate forward, rearward, rightward, and leftward in conjunction with the operation of the seat, and thus, a further sense of safety can be given to the seated person.

In addition, all of the embodiments described above disclose the center-of-gravity movement mechanism P as the configuration of the return-force generation mechanism, and naturally, provision of an elastic means such as a spring shall not be precluded as long as it is configured to return the seat to the reference position.

Further, a "buffer means" configured to buffer a bumping feeling upon reaching the operation end of the seat may be provided between the seat or the backrest, and the support mechanism, or within the support mechanism. Specific examples include a buffer member provided either in a contact unit provided on the bottom surface side of the seat or on a unit to be contacted provided on an outer wall of the support mechanism.

Further, in each of the above-described embodiments, the seat is held at the reference position by exclusively using its own weight of the seat; however, a "reference position holding means" may be provided so that any reference position can be set. A specific example may include a balancer, provided in the seat, for adjusting a position of the center of gravity of the seat. Further, a lock means configured to lock the seat at the reference position when the seated person does not sit and to unlock the seat when the seated person sits may be provided as a part of the support mechanism. With such a means, the seated person may easily sit on the seat at the reference position while suppressing undesirable swinging of the seat before sitting, and the seated person may obtain a desirable sitting comfort as a result of being unlocked by sitting.

In addition, it is possible to apply various modifications to another detailed configuration such as a specific shape or material of the seat without departing from the gist of the present invention.

INDUSTRIAL APPLICABILITY

The present invention can be applied to a chair suitably applicable to an office rotating chair and the like.

DESCRIPTION OF REFERENCE NUMERALS

1 Leg
12 Caster
16 Rotation support mechanism
3 Seat
4 Backrest
5 Suspension support mechanism (support mechanism)
51 Left-right support unit
52 Front-rear support unit
7 Joint support mechanism (support mechanism)
72 Both-end universal joint 72
G Center of gravity
P Return-force generation mechanism (center-of-gravity movement mechanism)
Q Seat inclining function (seat inclining mechanism)
R Shockless unit
S Reference position

The invention claimed is:

1. A chair comprising: a leg erected on a floor surface;

a seat arranged above the leg; and a suspension support mechanism configured to operatively support a predetermined location of the seat, in a front-rear direction and in a right-left direction, along a predetermined trajectory by suspending a part of the seat from a part of the leg, wherein the suspension support mechanism has a seat inclining function of inclining a front end side in a movement direction of the seat downward when the seat operates from a reference position where the seat can be rested by its own weight, and a return force generation function of generating a return force in a direction of returning the seat to the reference position by raising the center of gravity of the seat according to the amount of movement as the seat moves in a front-rear direction or in a right-left direction; and wherein the suspension support mechanism is set so that a distance between lower ends of a plurality of link members is shorter than a distance between upper ends of the plurality of link members that suspends a part of the seat from above.

2. The chair according to claim 1, wherein the leg includes a lifting and lowering mechanism, the seat is arranged above the lifting and lowering mechanism, and the suspension support mechanism is interposed between the lifting and lowering mechanism and the seat.

3. The chair according to claim 2, wherein the suspension mechanism is a link mechanism including a link member extending in an up-down direction.

4. The chair according to claim 3, wherein the suspension support mechanism includes a shockless unit configured to avoid or absorb a shock caused by a collision between the link members at an operation end.

5. The chair according to claim 4, wherein the support mechanism includes a slowing portion configured to slow an operation of the link member in accordance with its closeness to an operation end of the link member.

6. The chair according to claim 3, wherein the support mechanism includes a slowing portion configured to slow an operation of the link member in accordance with its closeness to an operation end of the link member.

7. The chair according to claim 3, wherein the link member is configured as a universal joint of which both ends are pivotably supported in both a front-rear direction and a right-left direction, and the seat and the leg are coupled via the universal joint.

8. The chair according to claim 7, wherein the suspension support mechanism includes a shockless unit configured to avoid or absorb a shock caused by a collision between the link members at an operation end.

9. The chair according to claim 7, wherein the support mechanism includes a slowing portion configured to slow an operation of the link member in accordance with its closeness to an operation end of the link member.

10. The chair according to claim 7, wherein a plurality of link members is provided at a position surrounding the center of the seat in planar view.

11. The chair according to claim 10, wherein the suspension support mechanism includes a shockless unit configured to avoid or absorb a shock caused by a collision between the link members at an operation end.

12. The chair according to claim 10, wherein the support mechanism includes a slowing portion configured to slow an operation of the link member in accordance with its closeness to an operation end of the link member.

13. The chair according to claim 10, wherein the number of the plurality of link members provided is three.

14. The chair according to claim 1, wherein the suspension support mechanism includes a front-rear support unit configured to operatively support the seat in a front-rear direction and a left-right support unit provided separately from the front-rear support unit and configured to operatively support the seat in a left-right direction.

15. The chair according to claim 14, wherein the front-rear support unit and the left-right support unit are arranged so that the up-and-down positions overlap at a position surrounding the center of the seat.

16. The chair according to claim 14, wherein the front-rear support unit is arranged above the left-right support unit.

17. A seat support mechanism for supporting a seat, wherein the seat support mechanism is configured to operatively suspend and support a predetermined location of the seat in a front-rear direction and a left-right direction along a predetermined trajectory by suspending a part of the seat provided above the leg from a part of the leg erected from the floor surface, and the suspension support mechanism has a seat inclining function of inclining a tip side in a movement direction of the seat downward when the seat moves from a reference position where the seat can be rested by its own weight, and a return force generation function of generating a return force in a direction of returning the seat to the reference position by raising the center of gravity of the seat according to the amount of movement as the seat moves in a front-rear direction or in a right-left direction, wherein the suspension support mechanism is set so that a distance between lower ends of a plurality of link members is shorter than a distance between upper ends of the plurality of link members that suspends a part of the seat from above.

18. The seat support mechanism according to claim 17, wherein the support mechanism includes a front-rear support unit configured to operatively support the seat in a front-rear direction and a left-right support unit provided separately from the front-rear support unit and configured to operatively support the seat in a left-right direction.

19. The seat support mechanism according to claim 18, wherein the front-rear support unit and the left-right support unit are arranged so that the up-and-down positions overlap at a position surrounding the center of the seat.

* * * * *